US009869091B2

(12) United States Patent
Sorkin

(10) Patent No.: US 9,869,091 B2
(45) Date of Patent: Jan. 16, 2018

(54) POCKET CAP FOR POST-TENSIONED CONCRETE MEMBER

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 15/226,334

(22) Filed: Aug. 2, 2016

(65) Prior Publication Data

US 2017/0037623 A1 Feb. 9, 2017

Related U.S. Application Data

(60) Provisional application No. 62/200,945, filed on Aug. 4, 2015.

(51) Int. Cl.
*E04C 5/12* (2006.01)
*E04C 5/16* (2006.01)
*B28B 23/04* (2006.01)

(52) U.S. Cl.
CPC ..... *E04C 5/122* (2013.01); *B28B 23/046* (2013.01); *E04C 5/162* (2013.01)

(58) Field of Classification Search
CPC ..... E04C 5/122; E04C 5/125; E04C 5/161; E04B 1/06; E04B 1/22; B28B 23/046
See application file for complete search history.

(56) References Cited

U.S. PATENT DOCUMENTS 3,137,971 A 6/1964 Rhodes
3,685,934 A 8/1972 Huber et al.
3,766,609 A 10/1973 Brandestini et al.
3,956,797 A 5/1976 Brandestini et al.
4,363,462 A * 12/1982 Wlodkowski ..... E04C 5/12 24/115 M
4,773,198 A * 9/1988 Reinhardt ..... E04C 5/122 52/223.13
4,822,270 A * 4/1989 Bonissone ..... B29C 33/02 249/122
4,918,887 A 4/1990 Davis et al.
5,072,558 A 12/1991 Sorkin et al.
5,271,199 A * 12/1993 Northern ..... E04C 5/12 24/122.6

(Continued)

FOREIGN PATENT DOCUMENTS

DE 2062738 A1 6/1972
DE 202008001248 U1 3/2008

(Continued)

OTHER PUBLICATIONS

International Search Report and Written Opinion issued in PCT application No. PCT/US16/45147, dated Dec. 28, 2016 (10 pages).

(Continued)

*Primary Examiner* — Christine T Cajilig
(74) *Attorney, Agent, or Firm* — Adolph Locklar

(57) ABSTRACT

A system for post tensioning a concrete member is disclosed. The system may include an anchor body, and a strand, the strand inserted through the anchor body. The strand may have a strand end and an outer diameter. The system may also include a pocket cap, the pocket cap positioned around the strand. The pocket cap may have a cylindrical interior wall, the cylindrical interior wall having a pocket cap diameter corresponding to the outer diameter of the strand.

25 Claims, 3 Drawing Sheets

(56) References Cited

U.S. PATENT DOCUMENTS 5,423,362 A * 6/1995 Knight ..... B28B 7/16 249/142
5,436,425 A * 7/1995 Sorkin ..... B23K 10/00 219/121.39
5,749,185 A 5/1998 Sorkin
5,755,065 A * 5/1998 Sorkin ..... E04C 5/12 52/223.13
5,788,398 A 8/1998 Sorkin
5,839,235 A * 11/1998 Sorkin ..... E04C 5/10 24/122.6
5,897,102 A * 4/1999 Sorkin ..... E04C 5/12 249/43
6,023,894 A * 2/2000 Sorkin ..... E04C 5/122 24/122.6
6,027,278 A 2/2000 Sorkin
6,098,356 A 8/2000 Sorkin
6,354,596 B1 * 3/2002 Rodriguez ..... E04C 5/12 174/153 G
6,381,912 B1 * 5/2002 Sorkin ..... E04C 5/08 24/459
6,588,193 B2 7/2003 Hayes
6,631,596 B1 10/2003 Sorkin
6,651,949 B1 * 11/2003 Westhoff ..... B28B 23/0043 249/142
6,761,002 B1 * 7/2004 Sorkin ..... E04C 5/12 403/374.1
6,883,280 B2 4/2005 Hayes
7,174,685 B2 * 2/2007 Hayes ..... E04C 5/12 52/223.6
7,216,842 B2 5/2007 Watson
7,275,347 B2 10/2007 Hayes
7,360,342 B2 4/2008 Hayes et al.
7,424,792 B1 * 9/2008 Sorkin ..... E04C 5/122 52/223.13
7,618,217 B2 11/2009 Henderson
7,621,103 B1 11/2009 Sorkin
7,676,997 B1 * 3/2010 Sorkin ..... E04C 5/12 52/223.13
7,726,082 B2 6/2010 Hayes et al.
7,762,029 B2 7/2010 Hayes et al.
7,765,752 B2 8/2010 Hayes et al.
7,793,473 B2 9/2010 Sorkin
7,823,345 B1 11/2010 Sorkin
7,841,061 B1 11/2010 Sorkin
7,856,774 B1 12/2010 Sorkin
7,866,009 B1 1/2011 Sorkin
D635,278 S 3/2011 Stanford
7,950,196 B1 5/2011 Sorkin
7,950,197 B1 5/2011 Sorkin
7,963,078 B1 * 6/2011 Sorkin ..... E04C 5/122 24/122.3
8,015,774 B1 9/2011 Sorkin
8,051,615 B2 11/2011 Mathews et al.
8,065,845 B1 * 11/2011 Sorkin ..... E04C 5/122 24/115 M
8,069,624 B1 12/2011 Sorkin
8,087,204 B1 * 1/2012 Sorkin ..... E04C 5/08 52/223.13
8,104,246 B2 1/2012 Nieto et al.
8,146,306 B2 4/2012 Hayes et al.
8,251,344 B1 8/2012 Sorkin
8,276,334 B2 10/2012 Mathews et al.
8,286,309 B2 10/2012 Landry
8,756,885 B1 6/2014 Mathews et al.
8,904,721 B2 12/2014 Pantelides et al.
8,925,279 B2 1/2015 Pantelides et al.
8,931,152 B2 1/2015 Parente et al.
9,096,986 B2 8/2015 Henderson
9,097,014 B1 8/2015 Sorkin
9,163,405 B2 10/2015 Mathews et al.
9,303,406 B2 4/2016 Sorkin
9,317,191 B2 4/2016 Stanford
9,399,869 B2 7/2016 Sorkin
9,604,416 B2 * 3/2017 Sorkin ..... B28B 7/28
2002/0007604 A1 1/2002 Wallstein
2006/0033003 A1 * 2/2006 Watson ..... B28B 7/28 249/177
2006/0179742 A1 8/2006 Mathews et al.
2006/0201083 A1 9/2006 Hayes et al.
2007/0289239 A1 * 12/2007 Lee ..... E02D 31/02 52/426
2008/0083130 A1 4/2008 Parkes et al.
2012/0011788 A1 1/2012 Nieto et al.
2014/0223854 A1 8/2014 Gilling
2015/0300021 A1 * 10/2015 Hayes ..... B28B 23/046 33/700
2015/0330078 A1 11/2015 Sorkin
2015/0345142 A1 12/2015 Mathews et al.
2016/0208490 A1 7/2016 Wilson

FOREIGN PATENT DOCUMENTS

JP 2007070917 A 3/2007
KR 101174206 B1 8/2012

OTHER PUBLICATIONS

Extended European Search Report issued in EP application No. 16182614.4, dated Nov. 8, 2016 (7 pages).

* cited by examiner

POCKET CAP FOR POST-TENSIONED CONCRETE MEMBER

CROSS-REFERENCE TO RELATED APPLICATIONS

This application is a nonprovisional application that claims priority from U.S. provisional application No. 62/200,945, filed Aug. 4, 2015, which is hereby incorporated by reference in its entirety.

TECHNICAL FIELD/FIELD OF THE DISCLOSURE

The present disclosure relates generally to post-tensioned, pre-stressed concrete construction. The present disclosure relates specifically to anchors for use therein.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a desired strength by use of a post-tensioning tendon. The post-tensioning tendon may include for example and without limitation, anchor assemblies, the tension member, and sheathes. Traditionally, a tension member is constructed of a material that can be elongated and may be a single or a multi-strand cable. Typically, the tension member may be formed from a metal or composite material, such as reinforced steel. The post-tensioning tendon conventionally includes an anchor assembly at each end. The post-tensioning tendon is fixedly coupled to a fixed anchor assembly positioned at one end of the post-tensioning tendon, the "fixed-end", and stressed at the stressed anchor assembly positioned at the opposite end of the post-tensioning tendon, the "stressing-end" of the post-tensioning tendon.

Post-tension members are conventionally formed from a strand and a sheath. The strand is conventionally formed as a single or multi-strand metal cable. The strand is conventionally encapsulated within a polymeric sheath extruded thereabout to, for example, prevent or retard corrosion of the metal strand by protecting the metal strand from exposure to corrosive or reactive fluids. Likewise, the sheath may prevent or retard concrete from bonding to the strand and preventing or restricting movement of the sheath during post-tensioning. The sheath may be filled with grease to further limit the exposure of the metal strand and allow for increased mobility. Once installed in the concrete member, and before the strand is tensioned and sealed, the end of the tension member extending from the concrete member may provide an entry point for fluids such as water resulting from ambient humidity or precipitation.

SUMMARY

The present disclosure provides for a system for post tensioning a concrete member. The system includes an anchor body, and a strand, the strand inserted through the anchor body. The strand has a strand end and an outer diameter. The system also includes a pocket cap, the pocket cap positioned around the strand. The pocket cap has a cylindrical interior wall, the cylindrical interior wall having a pocket cap diameter corresponding to the outer diameter of the strand.

The present disclosure also provides for a method of forming a post-tensioned concrete member. The method includes positioning a post-tensioning tendon within a concrete form, the post-tensioning tendon including a tension member, fixed anchor, and a stressing end anchor. The tension member includes a strand. The method also includes positioning a pocket former between the stressing end anchor and the concrete form. The pocket former is coupled to the stressing end anchor, where the stressing end anchor has a stressing end anchor body. The method additionally includes pouring concrete into the concrete form thereby forming a concrete member and encasing the post-tensioning tendon and pocket former in the concrete member. The method includes forming a cavity in the concrete by removing the pocket former, the cavity corresponding to the outer shape of the pocket former. The cavity has a cavity surface. The method also includes coupling a pocket cap to the cavity surface.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
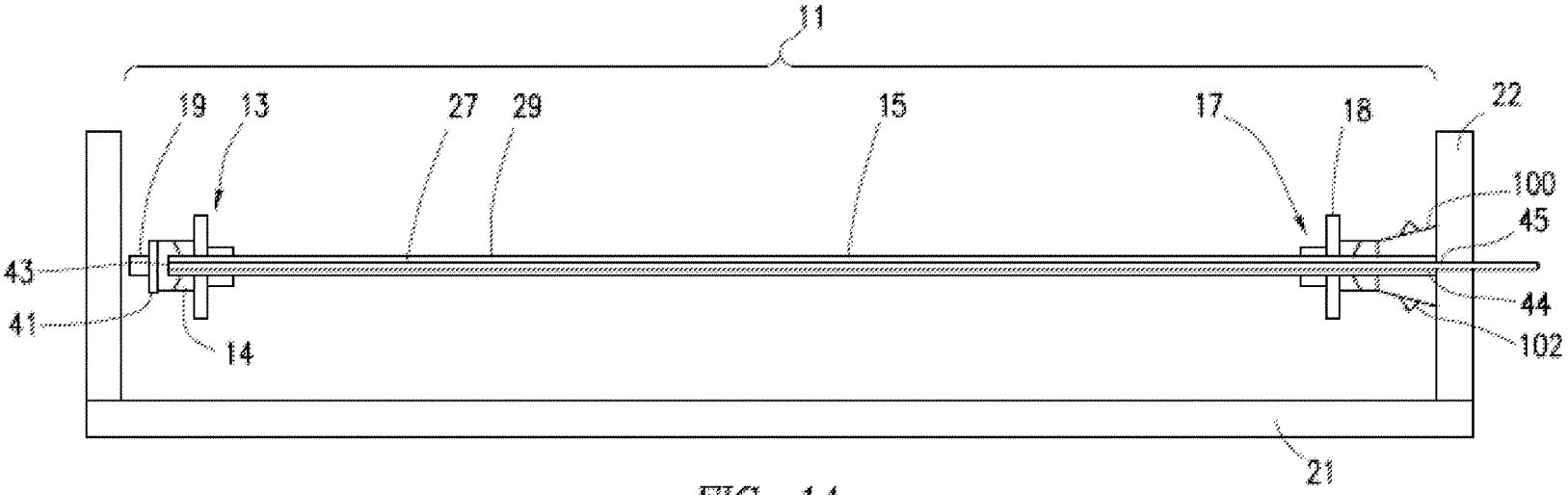
FIGS. 1A, 1B depict a partial cross section of a concrete post-tensioning tendon within a concrete form consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
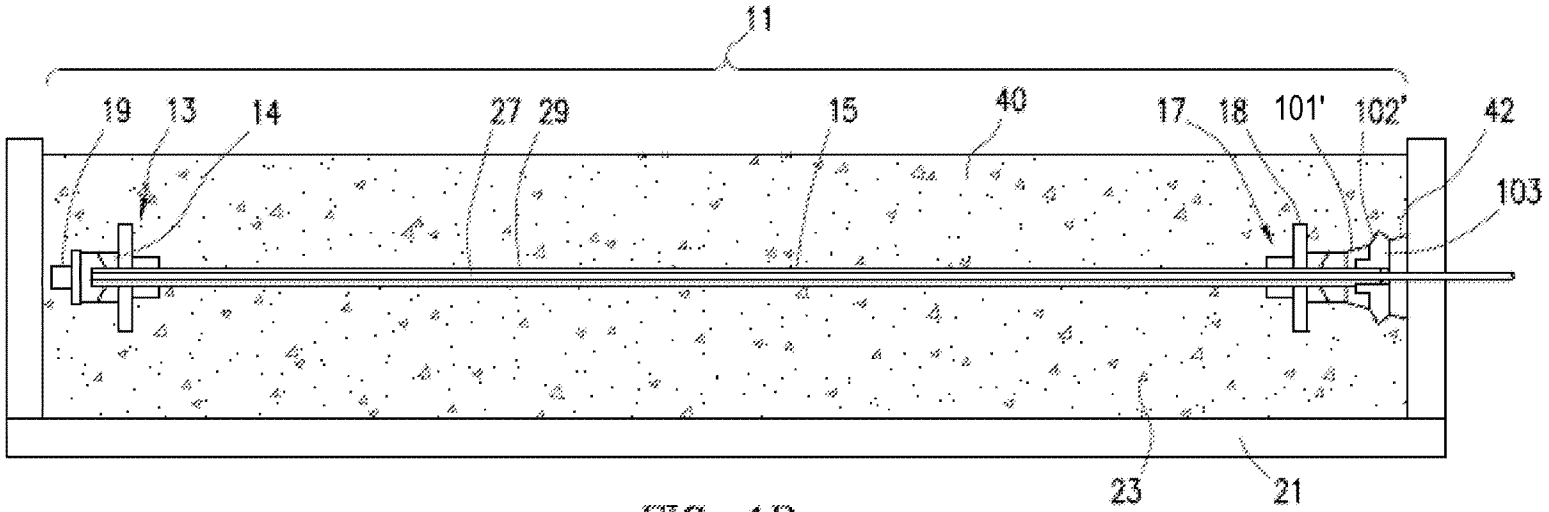

When stressing concrete member 40, anchoring systems may be provided to hold the tension member before and after stressing. In some embodiments, as depicted in FIGS. 1A, 1B, post-tensioning tendon 11 may be positioned within concrete form 21. Concrete form 21 is a form into which concrete may be poured to form concrete member 40. Post-tensioning tendon 11 may include for example and without limitation fixed end anchor 13, tension member 15, and stressing end anchor 17. As depicted in FIG. 1A, in some embodiments, fixed end anchor 13 may include fixed end anchor body 14. Fixed-end anchor body 14 may be positioned within concrete form 21 such that fixed-end anchor body 14 will be encased in concrete 23 after concrete is poured into concrete form 21. In some embodiments, fixed end cap 19 may be positioned at distal end 41 of fixed end anchor body 14. Fixed end cap 19 may, in certain embodiments, protect tension member 15 from corrosion after concrete 23 is poured by preventing or retarding corrosive or reactive fluids or concrete from contacting tension member 15.

In some embodiments, tension member 15 may include strand 27 and sheath 29. Strand 27 may be a single or multi-strand metal cable. Sheath 29 may be tubular or generally tubular and may be positioned about strand 27. In some embodiments, space between strand 27 and sheath 29 may be filled or partially filled with a filler such as grease. When installing tension member 15, in some embodiments, a length of sheath 29 may be removed from first end 43 of tension member 15, exposing strand 27. Strand 27 may be inserted through fixed end anchor body 14 and secured thereto, for example and without limitation, by one or more wedges. After strand 27 is secured, fixed end anchor body 14 may be installed in concrete form 21. Tension member 15 may be positioned within concrete form 21 and tension member 15 may be cut to correspond with the length of concrete form 21. In some embodiments, a length of sheath 29 may be removed from second end 44 of tension member 15, exposing strand 27. Strand 27 may be inserted through stressing end anchor body 18. After insertion of strand 27 through stressing end anchor body 18, stressing end anchor 17 may be positioned within concrete form 21. End wall 22 may include strand aperture 45 through which strand 27 may extend.

Pocket former 100 may be positioned between stressing end anchor body 18 and end wall 22 of concrete form 21. Pocket former 100 may be adapted to, for example and without limitation, prevent or restrict concrete 23 from filling the space between stressing end anchor body 18 and end wall 22, thus forming a cavity or pocket in edge 42 of concrete member 40 formed by concrete 23 within concrete form 21. Pocket former 100 may thus allow access to tension member 15 from outside concrete member 40 once concrete member 40 is sufficiently hardened and end wall 22 is removed. As used herein, "stressing end anchor assembly" refers to the combination of stressing end anchor 17, pocket former 100, and, as described hereinbelow, pocket cap 103.

Figure 2A:
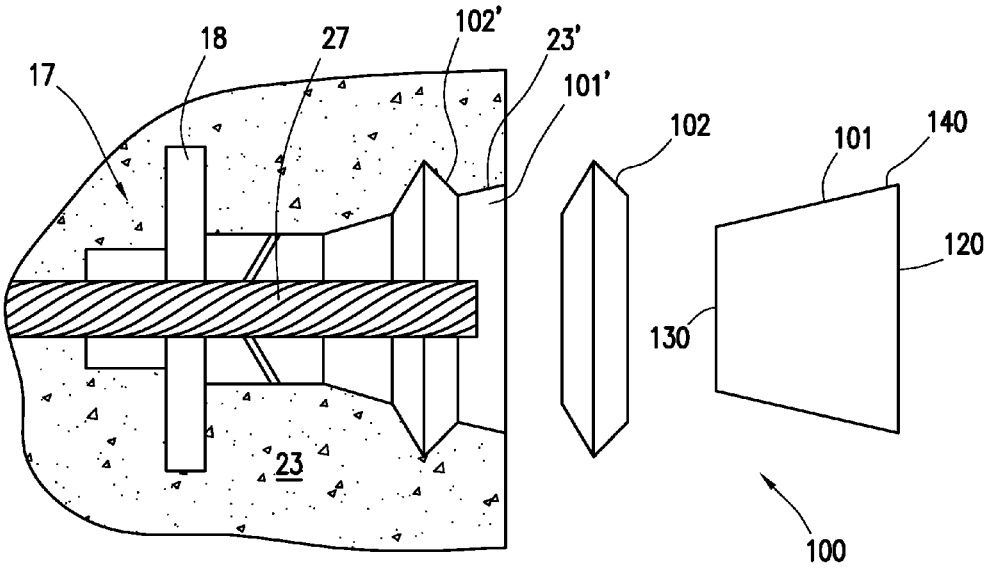
FIGS. 2A, 2B, 2C depict an anchor and pocket cap consistent with at least one embodiment of the present disclosure.
Figure 2B:
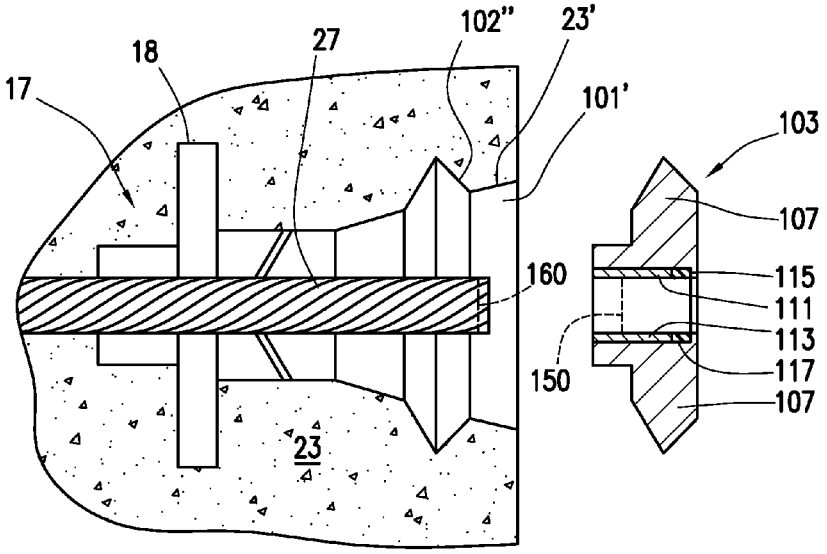

In some embodiments, as depicted in FIGS. 2A, 2B, pocket former 100 may include pocket former body 101. In some embodiments, pocket former body 101 may include a coupler for coupling pocket former 100 to stressing end anchor 17. In some embodiments, pocket former body 101 may be hollow. In some embodiments, pocket former body 101 may be a cylindrical or generally cylindrical member. Pocket former body 101 may be any shape suitable for providing a pocket in concrete 23 to allow access to the end of tension member 15 including, but not limited to, cylindrical, frustoconical, prismatoidal, ellipsoidal, or any combination thereof. Additionally, the cross-sectional shape of pocket former body 101 may be any shape including, but not limited to, square, round, oblong, ovate, ellipsoidal, triangular, polyhedral, or any combination thereof. As depicted in FIG. 2A, pocket former body 101 may be frustoconical or otherwise tapered from pocket former outer edge 120 to pocket former inner edge 130. In some embodiments, by tapering pocket former body 101 from pocket former outer edge 120 to pocket former inner edge 130, removal of pocket former body 101 from concrete 23 may be accomplished more easily than a non-tapered pocket former body. As depicted in FIG. 2A, when pocket former body 101 is removed from concrete 23 (once concrete 23 has reached a sufficient strength), cavity 101' is formed in concrete 23. The shape of cavity 101' may correspond with the outside shape of pocket former body 101.

In some embodiments, pocket former 100 may include keyway former 102. Keyway former 102 may be annular or generally annular and may be positioned on outer tapered surface 140 of pocket former body 101. As depicted in FIG. 2A, at least a part of keyway former 102 may extend radially outwardly from outer tapered surface 140 of pocket former body 101. As depicted in FIG. 2B, when keyway former 102 is removed from concrete 23, keyway 102' may be formed in concrete 23. Keyway 102' is a cavity within concrete 23. The shape of keyway 102' may correspond with the outside shape of keyway former 102.

Figure 2C:
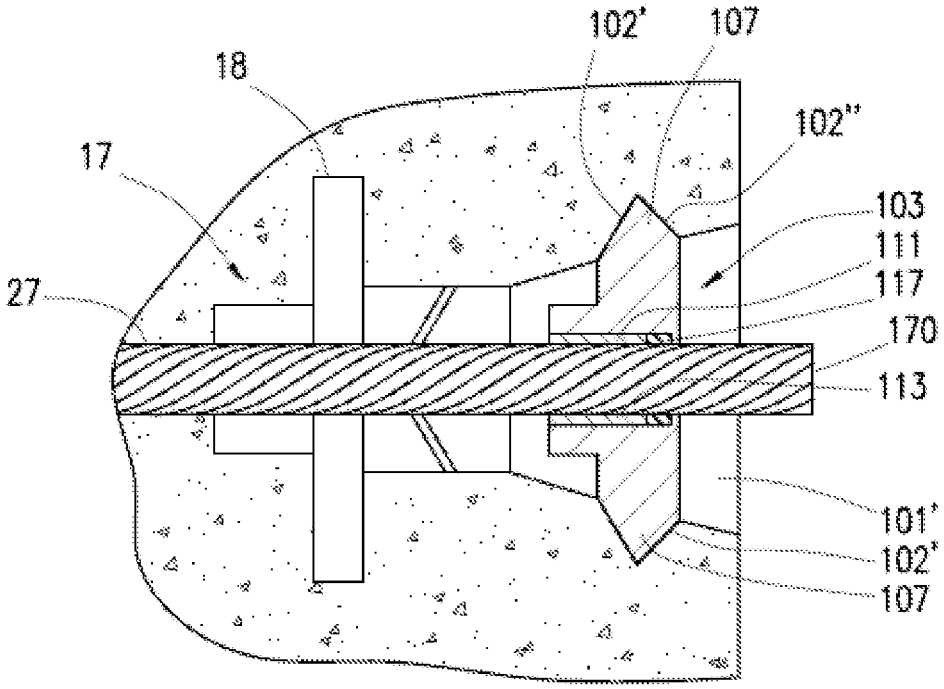
Figure 3:
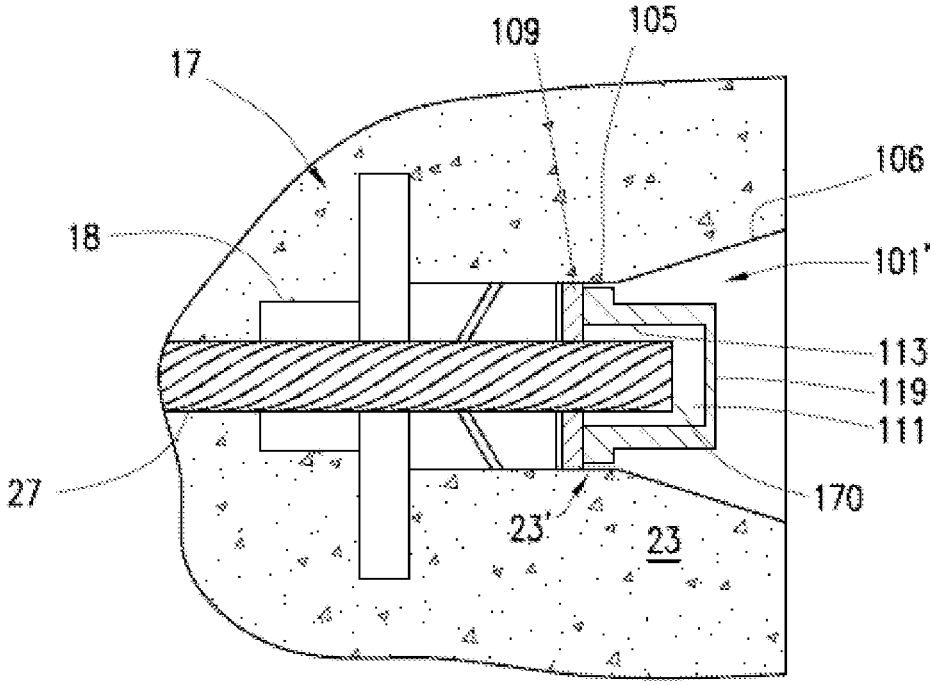
FIG. 3 depicts an anchor and pocket cap consistent with at least one embodiment of the present disclosure.

In some embodiments, pocket cap 103 may be positioned around strand 27. Pocket cap 103 may cover cavity 101' and prevent or restrict fluid intrusion thereinto. Pocket cap 103 may be positioned between cavity 101' and strand 27. In some embodiments, pocket cap 103 may be annular or generally annular. Pocket cap 103 may couple to keyway surface 102" using any coupling assembly known in the art, including, for example and without limitation, one or more extensions adapted to fit into keyway 102' or a threaded connection. In some embodiments, pocket cap 103 may include one or more extensions 107 that couple pocket cap 103 to keyway surface 102" as depicted in FIG. 2C. In some embodiments, as depicted in FIG. 3, cavity 101' may include cylindrical section 105 and frustoconical section 106. In such an embodiment, pocket cap 103 may fit within cylindrical section 105 by, for example and without limitation, a friction or press fit. In another embodiment, cylindrical section 105 may instead be tapered inwardly or outwardly. Surface 23' of concrete 23 in cavity 101' may, for example, be rough enough to retain pocket cap 103 therewithin without locking members.

In some embodiments, as depicted in FIGS. 2B, 2C, pocket cap 103 may be filled with a filler such as grease 111. Grease 111 may, for example and without limitation, prevent or restrict corrosive or reactive fluids from contacting strand 27. Grease 111 may be positioned within pocket cap 103 before pocket cap 103 is installed to cavity 101'.

In some embodiments, strand end 170 of strand 27 may pass through pocket cap 103. In some such embodiments, pocket cap 103 may have a cylindrical or generally cylindrical interior wall 113 having a pocket cap diameter 150 generally corresponding to strand outer diameter 160. In some embodiments, grease 111 may be positioned along cylindrical interior wall 113. In some embodiments, cylindrical interior wall 113 may terminate in end flange 115. End flange 115 may retain grease 111 within pocket cap 103. In some embodiments, one or more seals 117 may be positioned between cylindrical interior wall 113 and strand 27 to retain grease 111 within pocket cap 103.

In some embodiments, as depicted in FIG. 3, pocket cap 103 may enclose strand end 170 of strand 27. Pocket cap 103 may include cap end wall 119 positioned to retain grease 111 within pocket cap 103.

In some embodiments, gasket 109 as depicted in FIG. 3 may seal between stressing end anchor body 18 and pocket cap 103. Gasket 109 may be compressed between stressing end anchor body 18 and pocket cap 103. Gasket 109 may be formed from an elastic material such as rubber.

Post-tensioning tendon 11 may be positioned within concrete form 21 as depicted in FIG. 1A. Pocket former 100 of stressing end anchor 17 may be positioned such that pocket former 100 is in contact with end wall 22. Concrete 23, as depicted in FIG. 1B may be poured into concrete form 21 and allowed to set. End wall 22 of concrete form 21 may be removed. Pocket former 100 and, if included, keyway former 102 are removed from cavity 101' as depicted in FIG. 2A. In some embodiments, pocket cap 103 may be placed within cavity 101'. Pocket cap 103 may remain coupled to keyway surface 102" until access to strand 27 is desired, such as, for example, when strand 27 is to be post-tensioned; pocket cap 103 may be decoupled and removed to access strand 27. In some embodiments, pocket cap 103 may be removed from cavity 101', as depicted in FIG. 2B, by mechanical action.

Pocket cap 103 may be formed by, for example and without limitation, injection molding, milling, turning, or casting. Pocket cap 103 may be formed as a single unit or may include multiple components.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless explicitly stated otherwise, nothing herein is intended to be a definition of any word or term as generally used by a person of ordinary skill in the art, and nothing herein is a disavowal of any scope of any word or term as generally used by a person of ordinary skill in the art.

The invention claimed is:

1. A system for post tensioning a concrete member comprising:

an anchor body;

a pocket former coupled to the anchor body, the pocket former having a cylindrical section and a frustoconical section;

a strand, the strand inserted through the anchor body, the strand having a strand end and an outer diameter;

a pocket cap, the pocket cap configured to be positioned around the strand and to engage the cylindrical section of a cavity formed by the pocket former using friction or press fit and, the pocket cap having a cylindrical interior wall.

2. The system of claim 1, wherein the strand passes through the pocket cap.

3. The system of claim 2, wherein the cylindrical interior wall terminates in an end flange.

4. The system of claim 3 further comprising one or more seals positioned between the cylindrical interior wall and the strand.

5. The system of claim 2, wherein the pocket cap comprises extensions.

6. The system of claim 1, wherein the pocket cap contains grease.

7. The system of claim 1, wherein the pocket cap encloses the strand end.

8. The system of claim 7, wherein the pocket cap comprises a cap end wall, the cap end wall containing grease.

9. The system of claim 8 further comprising a gasket, the gasket compressed between the anchor body and the pocket cap.

10. A method of forming a post-tensioned concrete member comprising:

positioning a post-tensioning tendon within a concrete form, the post-tensioning tendon including a tension member, fixed anchor, and a stressing end anchor, the tension member including a strand;

positioning a pocket former between the stressing end anchor and the concrete form, the pocket former comprising a keyway former and being coupled to the stressing end anchor, the stressing end anchor having a stressing end anchor body;

pouring concrete into the concrete form thereby forming a concrete member;

encasing the post-tensioning tendon and pocket former in the concrete member;

forming a cavity in the concrete by removing the pocket former, the cavity corresponding to the outer shape of the pocket former, the cavity having a cavity surface;

removing the keyway former from the concrete member leaving a keyway in the cavity corresponding to the outer shape of the keyway former, the keyway having a keyway surface;

positioning a pocket cap around the strand; and coupling the pocket cap to the cavity surface by coupling an extension of the pocket cap to the keyway surface.

11. A method of forming a post-tensioned concrete member comprising:

positioning a post-tensioning tendon within a concrete form, the post-tensioning tendon including a tension member, fixed anchor, and a stressing end anchor, the tension member including a strand;

positioning a pocket former between the stressing end anchor and the concrete form, die pocket former comprising a keyway former and being coupled to the stressing end anchor, the stressing end anchor having a stressing end anchor body;

pouring concrete into the concrete form thereby forming a concrete member;

encasing the post-tensioning tendon and pocket former in the concrete member;

forming a cavity in the concrete by removing the pocket former, the cavity corresponding to the outer shape of the pocket former, the cavity having a cavity surface;

removing the keyway former from the concrete member leaving a keyway in the cavity corresponding to the outer shape of the keyway former, the keyway having a keyway surface;

coupling a pocket cap to the cavity surface by coupling an extension of the pocket cap to the keyway surface;

wherein the cavity has a cylindrical section and a frustoconical section and the pocket cap is positioned within the cylindrical section using friction or press fit.

12. The method of claim 11, wherein the pocket cap does not include a locking member.

13. The method of claim 11 further comprising filling the pocket cap with grease prior to coupling a pocket cap to the cavity surface.

14. The method of claim 11 further comprising prior to the step of coupling the pocket cap to the cavity surface:

forming the pocket cap by injection molding, milling, turning, or casting.

15. The method of claim 11 after the step of coupling the pocket cap to the cavity surface:

decoupling the pocket cap from the cavity surface.

16. A method of forming a post-tensioned concrete member comprising:

positioning a post-tensioning tendon within a concrete form, the post-tensioning tendon including a tension member, fixed anchor, and a stressing end anchor, the tension member including a strand;

positioning a pocket former between the stressing end anchor and the concrete form, the pocket former comprising a keyway former and being coupled to the stressing end anchor, the stressing end anchor having a stressing end anchor body;

pouring concrete into the concrete form thereby forming a concrete member;

encasing the post-tensioning tendon and pocket former in the concrete member;

forming a cavity in the concrete by removing the pocket former, the cavity corresponding to the outer shape of the pocket former, the cavity having a cavity surface;

removing the keyway former from the concrete member leaving a keyway in the cavity corresponding to the outer shape of the keyway former, the keyway having a keyway surface; and coupling a pocket cap to the cavity surface and coupling an extension of the pocket cap to the keyway surface, wherein the pocket cap comprises a cylindrical interior wall and the method further comprises positioning one or more seals between the cylindrical interior wall and the strand.

17. The method of claim 16 further comprising compressing a gasket between the stressing end anchor body and the pocket cap.

18. The method of claim 16 wherein the pocket former has an outer tapered surface and wherein the keyway former extends radially outward from the outer tapered surface of the pocket former.

19. The method of claim 16 further comprising filling the pocket cap with grease prior to coupling a pocket cap to the cavity surface.

20. The method of claim 16 further comprising prior to the step of coupling the pocket cap to the cavity surface:

forming the pocket cap by injection molding, milling, turning, or casting.

21. The method of claim 16 after the step of coupling the pocket cap to the cavity surface:

decoupling the pocket cap from the cavity surface.

22. The method of claim 10, wherein the pocket former has an outer tapered surface and wherein the keyway former extends radially outward from the outer tapered surface of the pocket former.

23. The method of claim 10 further comprising filling the pocket cap with grease prior to coupling a pocket cap to the cavity surface.

24. The method of claim 10 further comprising prior to the step of coupling the pocket cap to the cavity surface:

forming the pocket cap by injection molding, milling, turning, or casting.

25. The method of claim 10 after the step of coupling the pocket cap to the cavity surface:

decoupling the pocket cap from the cavity surface.

* * * * *